United States Patent [19]

Yamanishi et al.

[11] Patent Number: 4,518,031

[45] Date of Patent: May 21, 1985

[54] METHOD FOR MAKING MOLDS

[75] Inventors: Akio Yamanishi; Kanichi Sato, both of Hirakata, Japan

[73] Assignee: Kabushiki Kaisha Komatsu Seisakusho, Tokyo, Japan

[21] Appl. No.: 237,767

[22] Filed: Feb. 24, 1981

[51] Int. Cl.[3] ..... B22C 1/22; B22C 9/00

[52] U.S. Cl. ..... 164/526; 164/6; 164/15

[58] Field of Search ..... 164/6, 12, 21, 48, 250.1, 164/511, 518, 526, 33, 138, 15

[56] References Cited

U.S. PATENT DOCUMENTS

| | | | |
|---|---|---|---|
| 3,993,620 | 11/1976 | Yamanishi | 260/38 |
| 4,126,651 | 11/1978 | Valentine | 264/25 |

FOREIGN PATENT DOCUMENTS

| | | | |
|---|---|---|---|
| 2201020 | 7/1973 | Fed. Rep. of Germany | 164/138 |
| 50-27026 | 9/1975 | Japan | 164/138 |
| 52-15368 | 4/1977 | Japan | 164/138 |
| 53-100126 | 9/1978 | Japan | 164/6 |
| 55-84244 | 6/1980 | Japan | 164/526 |
| 1439181 | 6/1976 | United Kingdom | 164/21 |

OTHER PUBLICATIONS

Transactions of the American Foundrymen's Society, vol. 90, (1982), pp. 445-453.

*Primary Examiner*—Nicholas P. Godici
*Assistant Examiner*—Richard K. Seidel
*Attorney, Agent, or Firm*—Armstrong, Nikaido, Marmelstein & Kubovcik

[57] ABSTRACT

A method for making a mold employing a flexible pattern and a microwave radiation. A flexible pattern is formed with a material which allows microwave to pass therethrough and which pattern is then coated with a liquid facing agent, including a dielectric material to the microwave, a thermosetting resin, and refractory material powders, by either dipping or spraying. The coated pattern is covered by a molding material, including a thermosetting resin and a dielectric material to the microwave, and then the molding material covered pattern is exposed to a microwave radiation for a time sufficient to harden the molding material, and finally the pattern is separated from the hardened molding material leaving a facing agent covered mold behind.

3 Claims, 2 Drawing Figures

METHOD FOR MAKING MOLDS

BACKGROUND OF THE INVENTION

This invention relates to a method for making molds.

One of the conventional methods for making molds comprises forming a metal pattern, heating the metal pattern to an elevated temperature, applying a molding material including a thermosetting resin therein to the heated metal pattern, thereby hardening the molding material by heat conduction from the heated metal pattern, and finally separating the metal pattern from the hardened molding material. In this method, however, since the pattern is made of metal, the cost for making the pattern will necessarily become expensive and it is difficult to produce a complicated pattern shape. Besides, the molding material is hardened by the heat conduction from the metal pattern which produces a great deal of energy loss. Therefore, poor energy efficiency is obtained.

Another conventional method for making molds includes forming a metal pattern, heating the metal pattern to an elevated temperature of about 250° C., coating a powdered facing agent on the heated metal pattern by spraying, applying a molding material including a thermosetting resin therein to the facing agent coated and still heated metal pattern, thereby hardening the molding material by heat conduction from the heated metal pattern, and finally separating the metal pattern from the hardened molding material.

The casting surface of cast product produced by using this mold is very fine and it is possible to obtain a roughness of 200 RMS for aluminum and 300 RMS for FC material of Japanese Industrial Standard. This method too, however, has the same problems associated with the metal pattern described above. Besides, this method has the following problems. First, since a powdered facing agent is employed, it is difficult to effectively coat a pattern having a complicated shape. Secondly, since it is necessary to spray the powdered facing agent in a direction perpendicular to the surface of the metal pattern, a special spraying device must be employed. Thirdly, in the case of employing shell mold sand, the coated facing agent will likely be blown off.

SUMMARY OF THE INVENTION

It is therefore an object of the present invention to provide a method for making a mold which can overcome the above noted problems.

Another object of the present invention is to provide a method for making a mold wherein it is easy to provide a pattern used therein and production cost thereof is inexpensive.

A further object of the present invention is to provide a method for making a mold which can improve energy efficiency significantly by using the microwave radiation for heating.

A still further object of the present invention is to provide a method for making a mold which can provide a fine casting surface of the cast product.

Still another object of the present invention is to provide a method for making a mold wherein a facing agent employed therein is in the form of liquid, thereby enabling easy and economic mold making, yet providing a finer casting surface of the cast product than using a powdered facing agent, as in a conventional method.

In accordance with an aspect of the present invention, there is provided a method for making a mold, comprising the steps of: forming a pattern with a material which allows microwaves to pass therethrough; covering said pattern with a molding material including a thermosetting resin and a dielectric material to microwave radiation; exposing said molding material covered pattern to microwave radiation for the time sufficient to harden said molding material by the heat generated therein; and separating said pattern from said hardened molding material.

Since microwave radiation is employed for heating and hardening the molding material, heat loss can be minimized and energy efficiency is significantly improved in comparison to a typical conventional method employing the heat conduction from a heated metal pattern for heating and hardening the molding material.

Because the heat conduction from the pattern is not used, it is not necessary to use a metal pattern which is expensive and difficult to produce, especially in the case of complicated patterns.

Rather, a flexible pattern made of a silicon rubber, plastic, or the like can be used and is more suited than a metal pattern because of its dielectric property to the microwaves and easy production with less cost. Metal patterns are not suited for the present invention because metals are not a dielectric material in general.

In accordance with another aspect of the present invention, there is provided a method for making a mold, comprising the steps of: forming a pattern with a material which allows microwaves to pass therethrough; coating said pattern with a liquid facing agent by dipping or spraying; covering said coated pattern with a molding material including a thermosetting resin and a dielectric material to the microwaves; exposing said molding material covered pattern to microwave radiation for a time sufficient to harden said molding material by heat generated therein; and separating said pattern from said hardened molding material.

This embodiment provides, in addition to the above advantages associated with the first embodiment, very fine casting surfaces of cast products produced from the mold made by this method because of its provision of the facing agent coating made from the liquid facing agent.

A liquid facing agent is more advantageous than a powdered one because it is inexpensive to produce yet it is able to provide a finer casting surface than using a powdered facing agent.

The above and other objects, features, and advantages of the present invention will be readily apparent from the following description taken in conjunction with the accompanying drawings.

DESCRIPTION OF THE PREFERRED EMBODIMENTS

The present invention will now be described below with reference to the accompanying drawings. According to the first embodiment of the present invention, a pattern 1 is formed from a material such as silicone rubber or ceramic etc. which allows microwave radiation to pass or penetrate therethrough. The pattern 1 is set in a molding flask 2 and then a molding material 3 including refractory powders, a thermosetting resin and a dielectric material to the microwave radiation such as $Fe_3O_4$, is poured or dumped into the molding flask 2 to cover up the pattern 1.

Figure 1:
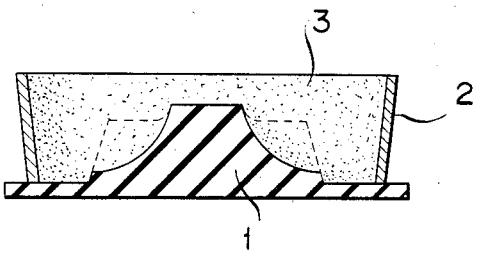
FIG. 1 is a cross-sectional view for explaining one embodiment of the present invention.
Figure 2:
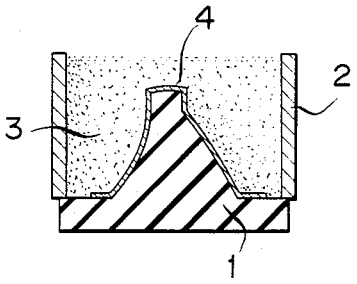
FIG. 2 is similar to FIG. 1 but showing another embodiment of the present invention.

Then the molding material covered pattern shown in FIG. 1 is exposed to a microwave radiation for a time sufficient to harden the molding material by the heat generated therein.

After the molding material has been hardened sufficiently, the pattern 1 is separated from the hardened molding material 3 to produce a mold for casting. Microwave as used herein has no specific wavelength and frequency but generally defined microwave can be adopted. According to the MacGraw-Hill Dictionary of Scientific and Technical Terms, microwave is defined as an electromagnetic wave which has a wavelength between about 0.3 and 30 centimeters, corresponding to frequencies of 1–100 gigahertz; however, there are no sharp boundaries distinguishing microwaves from infrared and radio waves. According to this method for making a mold, since the pattern 1 is not required to be directly heated to an elevated temperature and the molding material is not hardened by heat from the pattern 1, the pattern 1 is made of a material such as rubber, plastic or the like. Besides, metal patterns are not suited for the present invention because metals are not dielectric materials in general.

It will be appreciated that when phenol resin coated sand or powdered refractories are used as the molding material, the packing or filling operation of the molding material into the molding flask 2 becomes easy because this particular molding material has an excellent fluidity when it is in the dry state. Therefore, in contrast to the organic self-hardening mold process or the carbon dioxide process which requires a great skill to operate, little skill is required for effecting the filling operation of the molding material when such phenol resin coated sand are employed.

A mold which is complicated enough to require a plurality of separate patterns to make according to conventional methods, is produced by using a single flexible pattern according to the present invention. Therefore it is possible to enhance dimensional accuracies by avoiding any errors occurring in combining a plurality of patterns and therefore molds to produce a single mold assembly.

It is easy to control the hardening speed of the molding material by controlling the power output of the microwave radiation, the amount of addition of the dielectric material, and/or the exposure time under microwave radiation. Unlike other molding methods, the method according to the present invention is hardly affected by seasonal variations.

Molds produced by the present invention have the identical properties of thermosetting molds produced by other conventional methods. Accordingly, the method of the present invention not only has such advantages common to the organic self-hardening molds and the carbon dioxide process but also has advantages found in the thermosetting molds. Besides, little skill is required to operate and effect the process.

According to the second embodiment of the present invention, a liquid type of facing agent 4 is coated on the pattern 1 in order to provide a smooth casting surface of the cast product by dipping or spraying. The liquid facing agent is composed of a dielectric material to the microwave, a thermosetting resin and a powdered refractory material. The facing agent is either water soluble or alcohol soluble.

Other steps of this second embodiment are the same as those of the first embodiment explained above. Since a liquid type of facing agent is used for coating the surface of the flexible pattern 1 as opposed to a powdered facing agent employed in the conventional process, a smoother and finer casting surface can be obtained in comparison to the conventional process.

The method of the present invention is not only applicable to heat and harden shell mold sand but also applicable to any molding material including a thermosetting resin for binder.

EXAMPLE 1

A silicone rubber pattern was formed and a molding flask was mounted thereon.

A molding material in the form of resin coated sand including $Fe_3O_4$ therein was poured into the molding flask to cover up the rubber pattern and then the sand covered pattern was exposed to a microwave radiation having frequency of 2450 MHz and power output of 1 KW for five minutes. With this microwave radiation, the molding material had been sufficiently hardened and the rubber pattern was easily separated from the hardened molding material to produce a mold.

By giving a modest vibration to the flask and rubber pattern, the molding material was densely packed within the flask. At the time of microwave exposure, temperature in the silicone rubber pattern rose to only 70° C. and the pattern itself had enough durability.

EXAMPLE 2

A silicone rubber pattern was dipped into a liquid facing agent composed of 300 mesh silica 100 parts by weight, water soluble resol resin 10 parts by weight and water 60 parts by weight.

The facing agent coating was formed on the silicone rubber pattern.

A molding material in the form of shell mold sand was poured into a molding flask which encircles the silicone rubber pattern. The molding material was comprised of No. 6 and 7 silica admixed with 6% by weight novolak and resol resins including 5% by weight graphite powders therein.

The molding material covered silicone rubber pattern was exposed to a microwave radiation having frequency of 2450 MHz and power output of 1 KW for three minutes. Then the silicone rubber pattern was separated from the hardened molding material to produce a mold having a fine molding surface.

An aluminum alloy cast by this mold had very smooth casting surface in the order of 200 RMS.

EXAMPLE 3

A liquid facing agent composed of 400 mesh alumina powders 100 parts by weight, novolak and resol resins 5 parts by weight and methyl alcohol 30 parts by weight was sprayed onto the surface of a silicone rubber pattern to form a facing agent coating thereon.

A molding material composed of novolak resin coated sand admixed with 5% by weight magnetite powders was poured into a molding flask encircling the silicone rubber pattern.

Then the molding material covered silicone rubber pattern was exposed to a microwave radiation having frequency of 2450 MHz and power output of 1 KW for five minutes.

Then the silicone rubber pattern was separated from the hardened molding material to produce a mold having an excellent molding surface.

Although the present invention has been described with reference to specific examples, it should be understood that it is illustrative only and is not to be taken as a definition of the scope of the invention, reference being made for this purpose to the appended claims.

What we claim is:

1. A method for making a mold, comprising the steps of:

forming a pattern with a material which allows microwave radiation to pass therethrough;

coating said pattern with a liquid facing agent by dipping or spraying, said liquid facing agent including a dielectric material to microwave radiation, 5–20 parts by weight of a thermosetting resin based on 100 parts by weight of refractory material powders, and refractory material powders;

covering said coated pattern with a molding material including a thermosetting resin and dielectric material to microwave radiation, the dielectric material containing therein at least one substance selected from the group consisting of iron oxide, graphite and magnetite;

exposing said molding material covered pattern to microwave radiation for a time sufficient to harden said molding material by heat generated therein; and separating said pattern from said hardened molding material.

2. A method according to claim 1 wherein said pattern is flexible.

3. A method according to claim 1, or 2 wherein said molding material further includes phenol resin coated sand therein.

* * * * *